US005347921A

United States Patent [19]

Gourdol

[11] Patent Number: 5,347,921

[45] Date of Patent: Sep. 20, 1994

[54] PRESS FOR TREATING WASTE PRODUCTS

[75] Inventor: Jacques Gourdol, Varces-Allieres-Risset, France

[73] Assignee: Neyrpic Framatome Mecanique, Courbevoie, France

[21] Appl. No.: 735,309

[22] Filed: Jul. 24, 1991

[30] Foreign Application Priority Data

Jul. 26, 1990 [FR] France ..... 90 09578

[51] Int. Cl.[5] ..... B30B 9/06

[52] U.S. Cl. ..... 100/98 R; 100/127; 100/188 R; 100/251; 100/218; 100/232

[58] Field of Search ..... 100/98 R, 126, 127, 100/130, 179, 249, 251, 218, 131, 188 R, 282, 95

[56] References Cited

U.S. PATENT DOCUMENTS

| | | | |
|---|---|---|---|
| 2,705,916 | 4/1955 | Millgard | 100/98 R |
| 3,563,164 | 2/1971 | Carkhuff | 100/98 R |
| 3,980,014 | 9/1976 | McEwen et al. | 100/127 |
| 4,230,037 | 10/1980 | Schalz | 100/98 R |
| 4,421,022 | 12/1983 | Burgin | 100/98 R |
| 4,590,000 | 5/1986 | Baatz et al. | 100/249 |

FOREIGN PATENT DOCUMENTS

| | | | |
|---|---|---|---|
| 2510474 | 2/1983 | France . | |
| 2615443 | 11/1988 | France | 100/126 |
| 2615444 | 11/1988 | France . | |

*Primary Examiner*—Philip R. Coe
*Assistant Examiner*—Reginald L. Alexander
*Attorney, Agent, or Firm*—Pollock, Vande Sande & Priddy

[57] ABSTRACT

The press comprises a frame (1), a feed zone (3) for receiving the waste products, a pressing chamber (9) comprising an inlet opening (10) and an outlet opening (11) which are in opposed relation and disposed coaxially relative to the feed zone (3), and a chamber (14) for discharging the solid phase. The press further comprises an element (15) which is movable transversely relative to the axis of the press chamber (9) between a first position for closing the outlet opening (11) and a second position for opening the outlet opening (11), and an arrangement (20) for applying the movable element against the outlet opening (11) of the pressing chamber.

4 Claims, 4 Drawing Sheets

PRESS FOR TREATING WASTE PRODUCTS

FIELD OF THE INVENTION

The present invention relates to a press for treating heterogeneous waste products.

BACKGROUND OF THE INVENTION

In recent years, the increasing volume of waste products and in particular household refuse or garbage has made it necessary to search for solutions permitting the treatment and recycling of these waste products.

It has already been envisaged to employ such waste products as fuel, but the presence in these waste products of a high content of water and incombustible products results in only an insufficient amount of energy.

Indeed, such waste products are constituted by a liquid phase which only contains organic products and a solid phase which contains metallic, mineral and synthetic materials.

One solution consists in compressing these waste products so as to obtain residues which are dry enough to constitute a fuel having acceptable calorific power, fluid substances utilizable, according to their type, in agriculture as ground modifying products or as raw materials from which chemical products may be extracted.

Devices for compressing these waste products are already known and mostly consist of hydraulic presses including a feed zone receiving the waste products to be treated, a press chamber connected to means for recovering the liquid phase, and a chamber for discharging the solid phase located on the downstream side of the press chamber.

This press chamber comprises an inlet opening and an outlet opening and has a section equal to that of a piston of a first jack or ram.

The wall of the chamber comprises a multitude of perforations communicating with a passage for discharging the liquid phase extracted by compression of the waste products.

The outlet opening of the press chamber is usually closed by a plug carried by a rod of a second jack or ram opposed to the first-mentioned jack.

The pistons of the two jacks are movable in a reciprocating manner between a first position of compression of the waste products and discharge of the liquid phase during which the piston of the first jack enters the press chamber and the piston of the second jack closes the outlet opening of the chamber, and a second position of discharge of the solid phase during which the piston of the first jack continues its travel and the piston of the second jack opens the outlet opening of the said press chamber.

This type of press has drawbacks, and in particular presents problems as to the maintenance of the seal between the press chamber and the solid phase discharging chamber.

Indeed, bearing in mind the considerable forces involved when pressing the waste products, the seal is not fully achieved at the outlet opening of the press chamber by the piston of the second jack, so that leakages of liquid may occur and enter the solid phase discharging chamber.

Further, the travel of the piston of the second jack is relatively long. This travel corresponds to a thickness of the solid phase, namely, for an incompressible product, the equivalent of the length of the die, which therefore requires a large volume of oil to actuate this jack.

Bearing in mind this travel, the response time of the second jack is relatively long and rapid rates of operation cannot be obtained.

SUMMARY OF THE INVENTION

An object of the present invention is to avoid these drawbacks and to provide a press which is simple to construct and yet permits obtaining rates of operation which are higher than those of prior art presses.

The invention therefore provides a press for treating heterogeneous waste products comprising a solid phase and a liquid phase, said press comprising:

a frame, a feed zone for receiving the heterogeneous waste products to be treated which is open adjacent to the top thereof and comprises two opposed lateral openings having a section adapted to that of a compression piston movable between one of the openings of the feed zone and a position located beyond the other opening of the feed zone, a press chamber comprising an inlet opening and an outlet opening which are in opposed relation and coaxial relative to the feed zone, the chamber having a section equal to the section of the compression piston and comprising calibrated passages connecting the press chamber to liquid phase recovering means, and a chamber for discharging the solid phase located on the downstream side of the press chamber.

The press further comprises:

a closing and sealing element which has a shape complementary to the shape of the discharging chamber and is movable, on one hand, transversely relative to the axis of the press chamber, between a first position for closing the outlet opening of the press chamber during compression of the heterogeneous waste products, and a second position for opening the outlet opening for extracting the solid phase from the press chamber, and, on the other hand, along the axis of the press chamber by means for applying the said element against the outlet opening so as to seal the press chamber.

According to other features:

the transversely movable element consists of a slide controlled by a jack and guided by slideways connected to the frame, the lower part of the slide comprises blades for cleaning the walls of the discharging chamber, the movable element applying means comprise a jack whose piston moves along the axis of the press chamber.

BRIEF DESCRIPTION OF THE DRAWINGS

Further features and advantages of the invention will be apparent from the following description of an embodiment of the invention, with reference to the accompanying drawings which are given solely by way of example and in which.

DESCRIPTION OF PREFERRED EMBODIMENT

Figure 1:
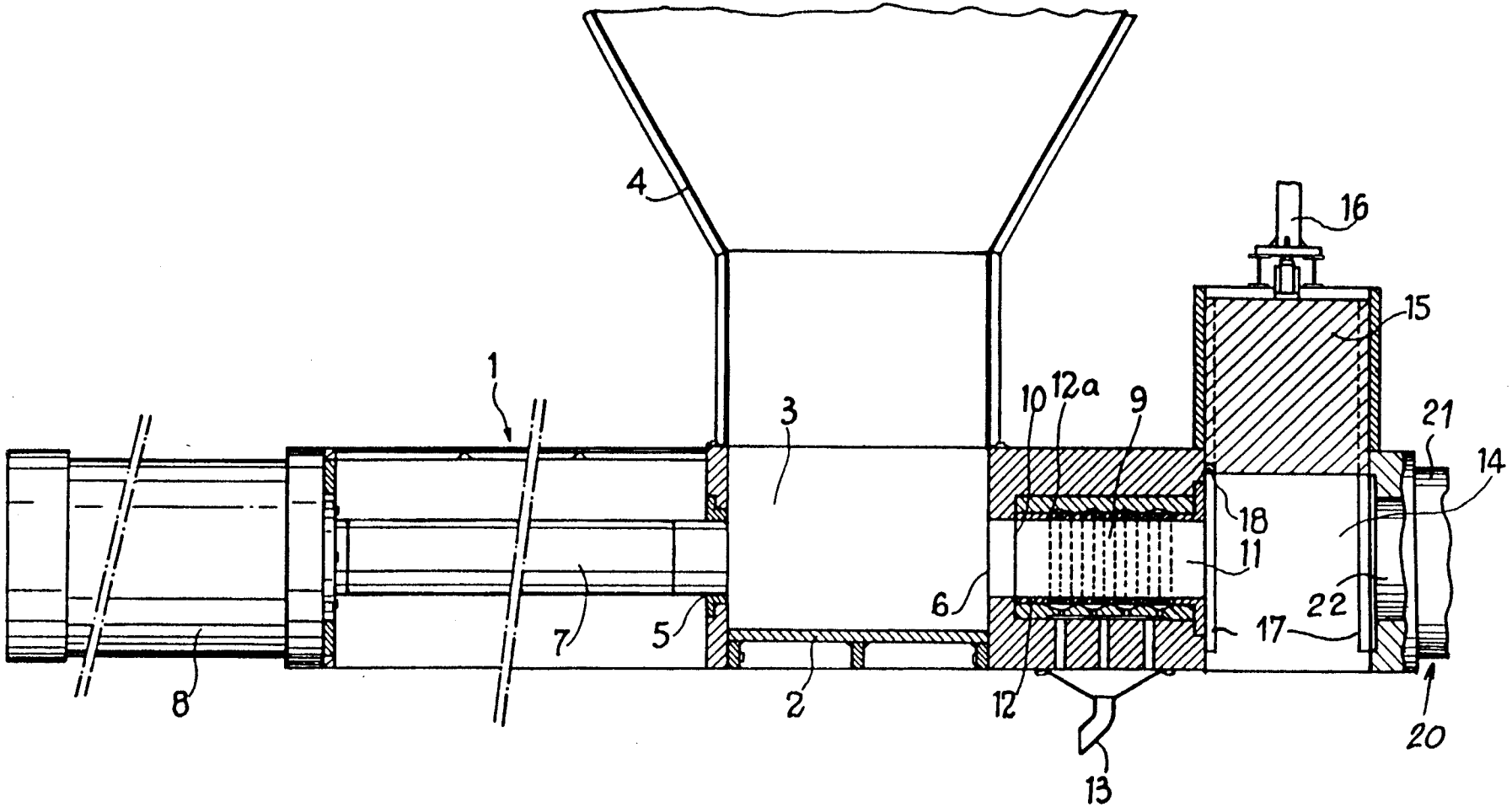
FIG. 1 is a schematic longitudinal sectional view of a press arranged in accordance with the invention.

The press shown in FIG. 1 comprises a frame 1 carrying a container 2 forming a feed zone 3 for heterogeneous waste products.

For this purpose, the feed zone 3 is open adjacent to the upper end thereof and surmounted by a hopper 4 equipped with at least one rammer (not shown) for introducing the waste products into feed zone 3.

This feed zone 3 comprises two opposed lateral openings 5 and 6 having a section is adapted to the section of a compression piston 7 of a jack or ram 8, for example a hydraulic jack, carried by the frame 1.

The piston 7 is movable between the opening 5 and a position located beyond the other opening 6 of the feed zone 3.

The opening 6 of the feed zone 3 communicates with an annular press chamber 9 coaxial with the feed zone 3 and having a section equal to the section of the piston 7. This press chamber 9 includes two opposed lateral openings 10 and 11.

The press chamber 9 comprises an internal a sleeve 12 provided with a multitude of small calibrated passages 12*a* which place the interior of press chamber 9 in communication with means for recovering the liquid phase through a chute 13.

The press chamber 9 communicates through the outlet opening 11 with a chamber 14 for discharging the solid phase of the waste products.

The sleeve 12 of the press chamber 9 is provided adjacent to the outlet opening 11 with an annular flange 12*b* (FIG. 2) defining externally a continuous contact surface.

Figure 2:
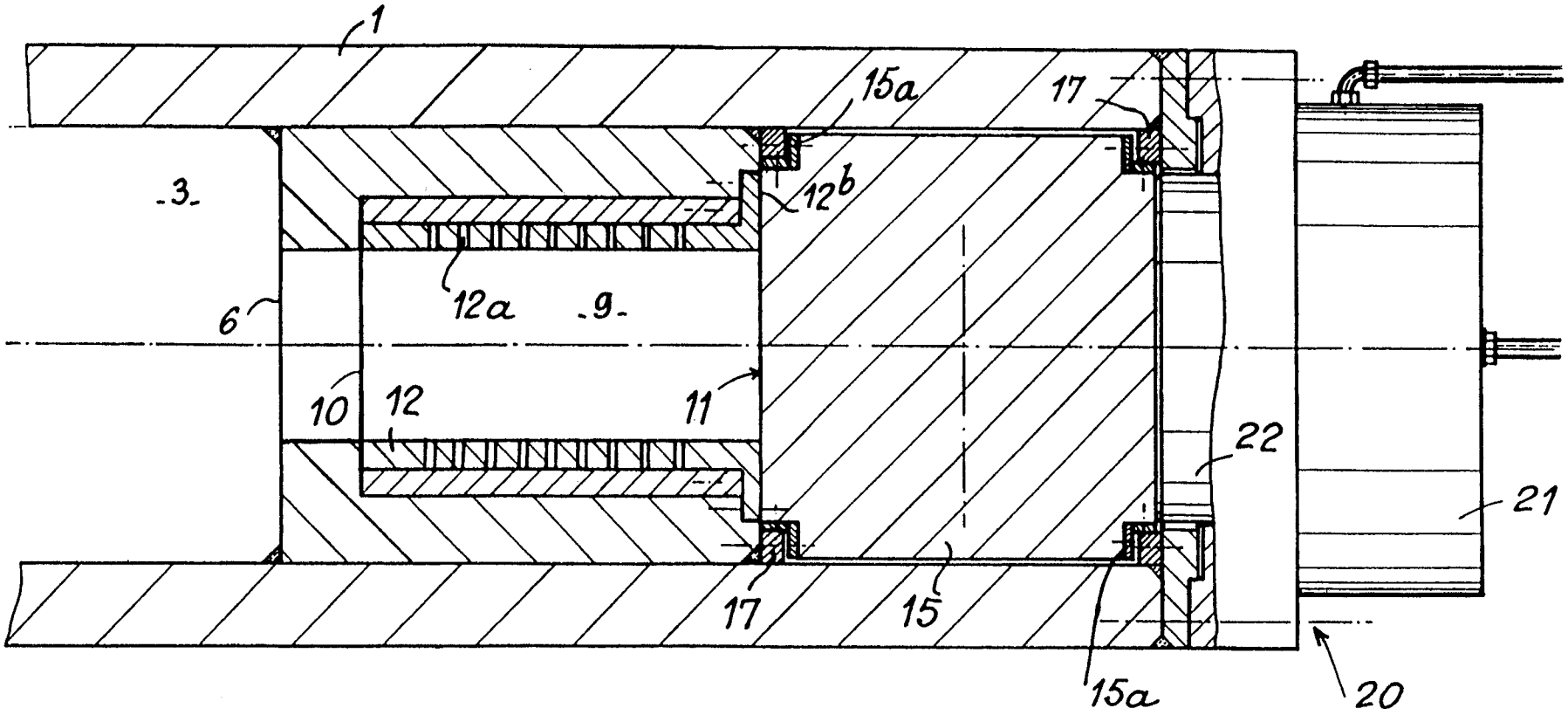
FIG. 2 is a top plan view to an enlarged scale of the means for closing the press chamber.

Mounted in this discharging chamber 14 is an element transversely movable relative to the axis of the press chamber 9. This movable element is formed by a slide having a parallel-sided shape complementary to the shape of the discharging chamber 14 (FIGS. 1 and 2).

The slide 15 is moved by the action of a jack 16, for example a hydraulic jack 16, between a first position for closing the outlet opening 11 of the press chamber 9 and a second position for opening said opening 11.

In the course of its movement, the slide 15 is guided by slideways 17 connected to the frame 1.

To this end, the corners of the vertical edges of the slide 15 are cut in an L-shape the sides of which are provided with guide strips 15*a* adapted to cooperate with the slideways 17.

A clearance is provided between the slide 15 and the slideways 17 to allow lateral displacement of the slide against the outlet opening 11 of the press chamber 9, as will be understood hereinafter.

Further, the slide 15 comprises, in the lower part of the sides in contact with the walls of the discharging chamber 14, blades 18 for cleaning the walls of this chamber in the course of the displacement of the slide.

The press further comprises means 20 for applying the slide against the outlet opening 11 of the press chamber 9.

These means 20 comprise a jack or ram 21, for example a hydraulic jack, which is located on the axis of the press chamber 9 and has a body connected to the frame 1 of the press and a piston 22 movable in a short travel along the axis of the press chamber 9.

The press just described operates in the following manner:

The heterogeneous waste products to be treated are introduced into the hopper 4 and urged into the feed zone 3, for example by a rammer (not shown).

At the beginning of the treatment cycle, the piston 7 is in a withdrawn position, as shown in FIGS. 1 and 2, so as to permit the introduction of the waste products into the feed zone 3.

Under the action of the jack 16, the slide 15 is placed in a lower position and closes the outlet opening 11 of the press chamber 9.

Figure 3:
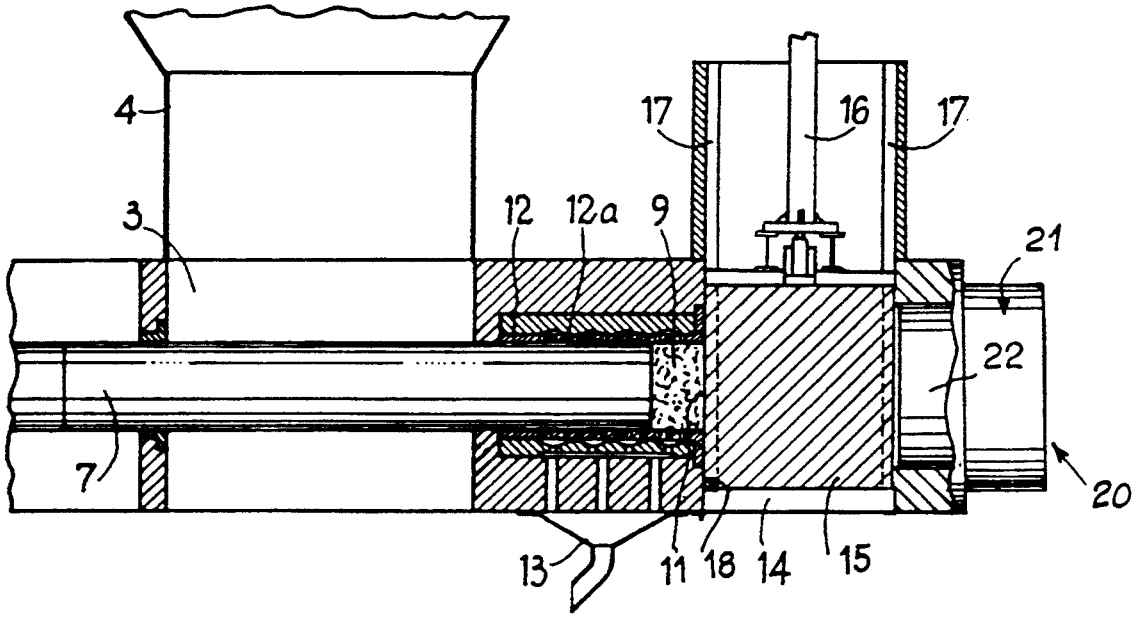
FIGS. 3 to 5 are schematic sectional views of the various steps of operation of the press according to the invention.

The piston 22 of the jack is shifted and comes into contact with the slide 15, and this has the effect of laterally shifting the slide 15 so that its side facing toward the outlet opening 11 is applied against the outer surface of the flange 12*b* (FIGS. 2 and 3).

The seal in the region of the outlet opening 11 is a seal of the metal-to-metal type achieved by the quality of the contacting surfaces and the applying force exerted by the piston 22 of the jack 21.

Thereafter, the piston 7 controlled by the jack 8 moves toward the press chamber 9 and pushes the waste products contained in the feed zone 3 toward this chamber.

In continuing its forward travel, the piston 7 urges the waste products into the press chamber 9 until a high pressure is reached and compresses the waste products in the chamber 9 against the slide 15.

As the waste products are compressed in the press chamber 9, the liquid phase is squeezed out of these raw waste products through the calibrated passages 12*a* provided in the sleeve 12 and discharged through the chute 13 (FIG. 3).

At the end of the pressing of the waste products, the piston 22 of the jack 21 is returned to its initial position and in this way releases the slide 15. The latter is raised by the action of the jack 16 so as to open the outlet opening 11 of the press chamber 9 (FIG. 3).

Figure 4:
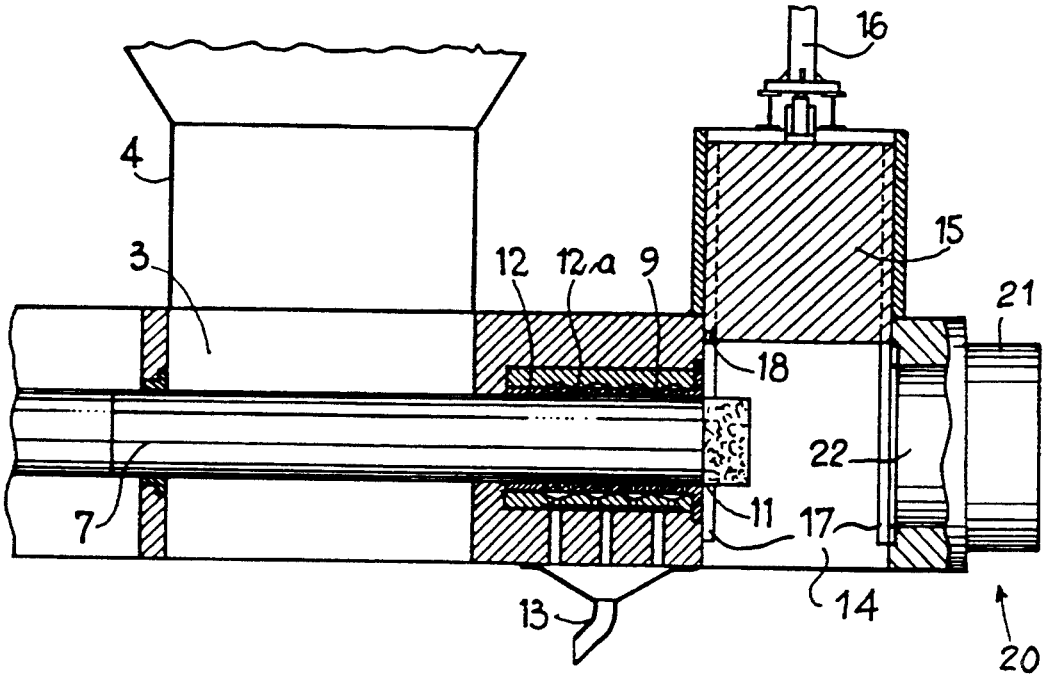
Figure 5:
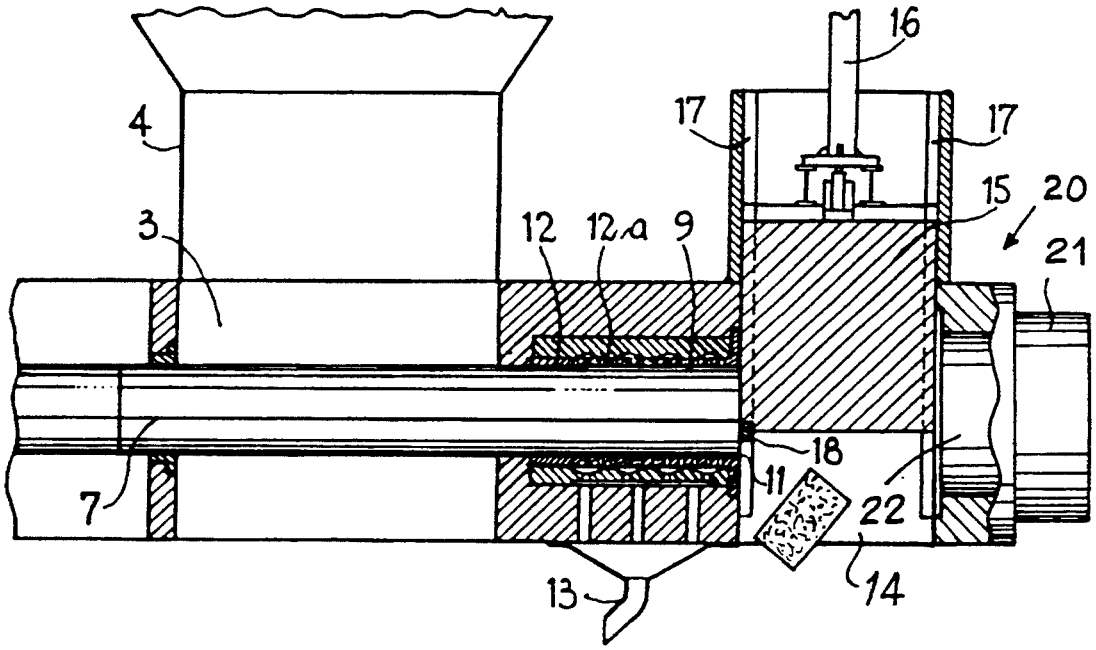

By the advance of the piston 7 through the pressing chamber 9, the solid and dry parts of the waste products are shifted out of this chamber (FIG. 4) and, thereafter, urged into the discharging chamber 14 by the descent of the slide 15 (FIG. 5).

Owing to the blades 18, the slide 15 acts as a shear in its downward travel in the event of a wedging of the solid parts and cleans the walls of the discharging chamber 14.

When the solid parts have been discharged, the piston 7 returns to its initial position for a new cycle of operation similar to the preceding cycle.

This system has the advantage of the possibility of using, for closing the outlet opening of the press chamber by means of the slide, a jack whose piston has a short travel, namely of the order of 5 mm, and whose oil capacity is small, whereby it is possible to obtain a shorter response time and increase the waste product treating rates.

It also has the advantage of obviating the need for sealing means in the region of the outlet opening of the press chamber. Such sealing means are, as is known, elements which rapidly deteriorate and therefore require frequent replacement.

What is claimed is:

1. A press for treating heterogeneous waste products comprising a solid phase and a liquid phase, said press comprising (a) a frame;

(b) means defining a feed zone for receiving said water products, said feed zone having a feed axis and being open adjacent an upper end thereof and defining two opposed lateral openings, a compression piston movable between one of said openings and a position located beyond the other of said openings, said lateral openings having a section adapted to a corresponding section of said piston;

(c) a press chamber having a pressing axis and comprising an inlet opening and an outlet opening which are in opposed relation to each other and disposed coaxially relative to said feed axis and pressing axis, said chamber having a section equal to a section of said compression piston, means for recovering said liquid phase, said press chamber comprising calibrated passages connecting said press chamber with said liquid phase recovering means;

(d) a chamber for discharging said solid phase located downstream of said press chamber relative to a direction of flow of said waste products through said press chamber;

(e) a closing and sealing element having a shape complementary to a shape of said discharging chamber and movable transversely relative to said axis of said press chamber between a lower position for closing said outlet opening of said press chamber during compression of waste products, and an upper position for opening said outlet opening for extracting said solid phase from said press chamber, said closing and sealing element being further movable along said axis of said press chamber; and (f) and means cooperating with said closing and sealing element for moving said closing and sealing element along said axis of said press chamber and applying said closing and sealing element against said outlet opening and thus sealing said press chamber.

2. Press according to claim 1, wherein said transversely movable element comprises a slide, said press further comprising a jack for moving said slide, and slideways connected to said frame and guidingly cooperating with said slide.

3. Press according to claim 2, wherein said slide has a lower part comprising blades for cleaning walls of said discharging chamber.

4. Press according to claim 1, wherein said means for applying said movable element against said outlet opening comprise a jack having a piston which is movable along said axis of said press chamber.

* * * * *